US005170507A

United States Patent [19]

Langford et al.

[11] Patent Number: 5,170,507

[45] Date of Patent: Dec. 15, 1992

[54] NECKTIE

[76] Inventors: Gordon B. Langford, 11193 S. Star Cir., Sandy, Utah 84092; Shane C. Mast, 4467 S. Albright Dr., Salt Lake City, Utah 84124

[21] Appl. No.: 525,083

[22] Filed: May 16, 1990

[51] Int. Cl.[5] ..... A41D 13/00

[52] U.S. Cl. ..... 2/150; 2/148; 2/149; 2/152 R; 2/152 A; 2/153

[58] Field of Search ..... 2/145, 148, 149, 150, 2/152 R, 152 A, 153, 155

[56] References Cited

U.S. PATENT DOCUMENTS

| | | | |
|---|---|---|---|
| 2,247,184 | 3/1940 | Burfening . | |
| 2,294,508 | 1/1941 | Minor . | |
| 3,127,618 | 4/1964 | Roach | 2/150 |
| 3,898,698 | 8/1975 | Byrd et al. | 2/150 |
| 3,942,192 | 3/1976 | Harris | 2/152 R |
| 4,513,453 | 12/1987 | Chen et al. | 2/150 |
| 4,656,672 | 4/1987 | Lande | 2/150 |
| 4,710,982 | 12/1987 | Lande | 2/150 |
| 4,771,481 | 9/1988 | Gasser | 2/152 R X |
| 4,835,794 | 6/1989 | Chen et al. | 2/150 |
| 4,856,114 | 8/1989 | Chen et al. | 2/150 X |
| 4,897,887 | 2/1990 | Chen et al. | 2/150 |

*Primary Examiner*—Werner H. Schroeder
*Assistant Examiner*—Jeanette E. Chapman
*Attorney, Agent, or Firm*—Trask, Britt & Rossa

[57] ABSTRACT

A preformed necktie has an insert with a pair of connected diverging closed conduits interconnected by a support. A slide post extends from the support proximate the lower ends of the conduits. A tie portion is wrapped about the insert to form a knot and to become the front tie panel. The two ends of a neck-embracing loop have corresponding zipper panels and pass through the conduits to be joined by the slide and form a rear panel of the tie. The neck embracing loop is tightened or loosened by movement through the knot and slide.

23 Claims, 2 Drawing Sheets

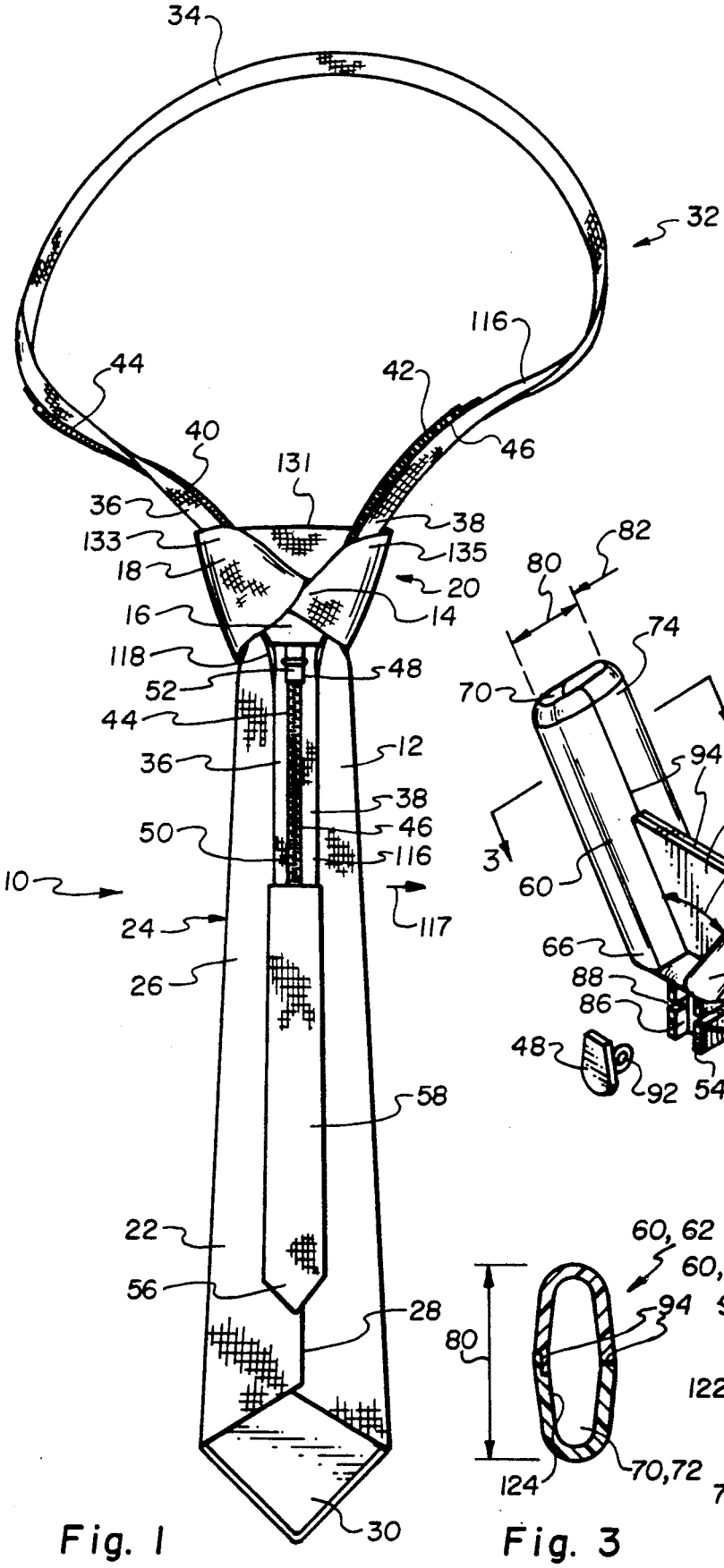
Fig. 1
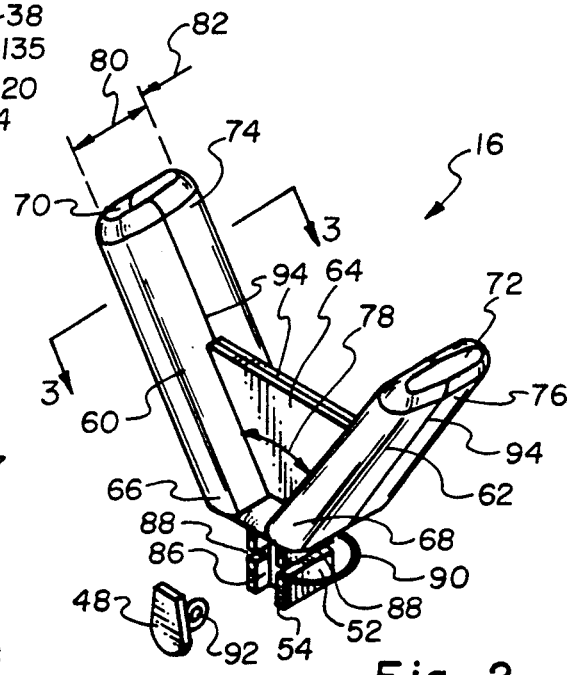
Fig. 2
Fig. 3
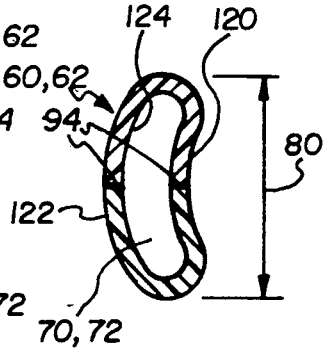
Fig. 4

NECKTIE

BACKGROUND OF THE INVENTION

1. Field

This invention relates to items of apparel and more particularly to preformed neckties which are readily fitted around a wearer's neck.

2. Description of the Prior Art

Neckties are an item of apparel and are typically secured around the neck. Four-in-hand ties may be formed into various knots (e.g., windsor, half windsor, overhand) which some find difficult or inconvenient to tie. As a result, several types of preformed neckties have been devised. Typical of such neckties are: U.S. Pat. No. 3,284,807 (Espino), U.S. Pat. No. 3,363,264 (Mathison), U.S. Pat. No. 4,024,585 (Girdler) and U.S. Pat. No. 4,337,539 (Najarian).

In the foregoing patents, the necktie is simply clamped or hooked to the shirt in the area where the shirt is buttoned together at the collar. In using such ties, the clamp or hook is often exposed to view. In addition, modern shirts with a large intercollar span make such ties conspicuous by the lack of a neck encircling portion (neck loop). Some users rely upon tightening of the tie neck loop to achieve a proper fit of the shirt about the neck even when the buttoned shirt collar otherwise hangs loosely on the wearer. Neckties without neck loops cannot compensate for differences in slackness.

U.S. Pat. No. 2,294,508 (Minor) discloses a necktie having a neck loop which is held in a preformed knot by a pointed zipper slide tab.

U.S. Pat. No. 2,247,184 (Burfening) discloses a preformed necktie having a neck loop which is closeable by a zipper. The zipper slide is outside of the tie knot, and is attached by a screw to a plate which forms the back of the fabric knot. The plate is sewn to the knot.

In Burfening, the pendent position of the neck loop (including the zipper) appears to be spaced from the front tie, and therefore would be visible, especially from the side. Furthermore, the knot itself would appear to stand away from the neck loop. In addition, the knot of Burfening appears to be built up of layers of cloth which may deform relative to the solid plate to adversely affect the aesthetic appearance of the knot.

Also, in Burfening the force holding the neck loop in the proper position on the wearer's neck depends only upon the friction in the zipper slide. As the zipper slide loosens with wear, the tie will tend to slip from the wearer's neck. Further, the fabrication of the Burfening tie would appear to require considerable cutting, folding and sewing which would in turn appear to increase production costs.

U.S. Pat. No. 3,127,618 (Roach) also discloses a preformed necktie with a separate neck loop closeable by a zipper. Unlike the Burfening device, the Roach neck loop passes through the built-up knot, and the zipper slide is held in the knot by its tab, which passes through a slot in the knot fabric. Alternatively, a hook shaped projection replaces the tab, and engages the lower rear edge of the knot to support the slide. Like the tie of Burfening, the Roach tie also appears to require considerable cutting, folding and sewing to form the knot.

U.S. Pat. No. 3,898,698 (Byrd, et al.) shows a preformed necktie which uses a rigid plate sewn into the rear portion of the knot. The plate has slide flanges which diverge upwardly. The slider tab is held in a slot formed on the plate wall. All of the resistance to opening the neck loop is derived from the slider friction. The knot portion of the tie is formed from folded cloth encircling the plate and sewn together at the back of the plate.

U.S. Pat. No. 3,942,192 (Harris) discloses a preformed four-in-hand necktie which differs from that of Byrd, et al. in that the knot is tieable and untieable by hand rather than comprising a permanent preformed structure.

U.S. Pat. No. 4,513,453 (Chen, et al.) discloses a pretied necktie ostensibly differing from the Harris structure only in that the knot support has a hollow slightly oval shape in its plan view. An M-shaped clamp may be used to stabilize the knot. The slider tab, knot support member and upper end of the outer tie member are joined by a rivet.

The Chen, et al. necktie, as well as other preformed neckties of the prior art suffer from a construction which permits the zipper to be rubbed or pressed against the knot fabric while the neck loop is being opened or closed. Those locations are on a visible portion of the knot, and the rapid wear which occurs limits the useful life of the necktie.

Much of the prior art suffers in that the visible features readily reveal that the necktie is not hand-tied. In some ties, undue manipulation is required for installation and removal. Others require excessive labor to produce and assemble.

There remains the need for a preformed necktie which is aesthetically indistinguishable from a hand-tied necktie when worn, is capable of absorbing long-term use and abuse without deforming, breaking or undue wear, is easily installed and removed, and may be produced with minimal labor.

SUMMARY OF THE INVENTION

The tie is formed from an insert, a front panel and a neck loop. A first elongate piece of fabric or other necktie material has a first end attached to an insert, as by adhesive. The piece is then wrapped around the insert in conventional four-in-hand fashion to form a knot which appears to be hand tied. The pendant end extends from the knot to be the visible front panel of the necktie.

A second separate fabric component comprises a neck loop with a pendent rear panel. Two portions of the neck loop have interlocking zipper bands attached to the inner edges. The loop may be enlarged or reduced in size by movement of the zipper bands through operation means attached to the insert.

The insert includes a pair of conduits which have passageways for carrying the interlocking zipper-carrying portions of the neck loop through the insert. The conduits diverge upwardly at an angle providing the desired flare of the knot. The conduits converge downwardly toward the attached operation means. The passageways direct the joinable portions of the neck loop toward the operation means in a manner which provides the desired resistance to movement and conceals the slide and insert from view.

The upper distal end of each conduit closely approaches the edge of the knot fabric and encloses the respective neck loop portions and directs the zipper band to a front location. Thus, the zipper does not abrade against the knot fabric. The useful life of the tie is significantly increased.

The preformed necktie of this invention has the appearance of a well-tied conventional four-in-hand necktie. The configuration of the insert enables formation of a knot with standard dimensions and proportions. Non-fabric parts, i.e., the insert and its protruding post are hidden from view. The outer and inner pendant portions of the tie are immediately adjacent one to another, and the inner pendent portion is turned along each edge to hide the insert post.

BRIEF DESCRIPTION OF THE DRAWINGS

Other features and advantages of the invention will be more evident from the following description taken in conjunction with the accompanying figures, wherein:

FIG. 1 is a general rear view of the necktie according to the invention;

FIG. 2 is a perspective view of an embodiment of the insert of the invention;

FIG. 3 is a cross-sectional view of the enclosed insert conduit of the invention;

FIG. 4 is a cross-sectional view of another embodiment of enclosed insert conduit of the invention;

DESCRIPTION OF PREFERRED EMBODIMENTS

Figure 5:
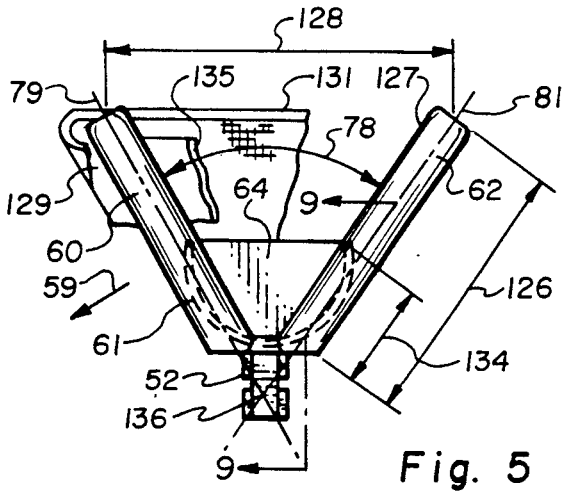
FIG. 5 is a front view of an embodiment of the insert in accordance with the invention.

As depicted in FIG. 1, the preferred necktie 10 of this invention has a first elongate fabric member 12 with an upper end 14 which is affixed to a rigid or semi-rigid knot insert 16 by adhesive or other fastening means. The upper portion 18 of member 12 is passed around insert 16 to form knot 20; and the remaining pendant portion 22 extends from the knot 20 to become the front panel 24 of the necktie 10. Only the rear face 26 of pendant portion 22 is visible in the view of FIG. 1. The opposite front side has the appearance of a conventional hand-tied four-in-hand necktie.

Typically, the first fabric member 12 is formed from a single piece of material which is folded lengthwise and secured, along seam 28 by sewing or other acceptable means. The pendant portion 22 may also be lined with additional fabric or sheet material 30 for aesthetic reasons or to provide additional stiffness.

An elongate narrow neckband 32 has a neck loop 34 which encircles the shirt collar (not shown) of the wearer. Neckband 32 may be formed of flexible fabric which is folded and sewn to form a double-faced strip. As can be seen the neck loop 34 has lower portions 36 and 38. Linear joining means are attached to the lower portions 36 and 38 so that the portions may be joined to each other. As here shown, the linear joining means is a zipper having two zip bands 40 and 42 one each secured to the inside edges 44 and 46 of the lower portion 36 and 38 as shown.

The lower portions 36 and 38 of neck loop 34 are movably conducted through insert 16 within knot 20. The zipper has a slide 48 which interlocks zipper bands 40 and 42 to form zipper joint 50 which connects portions 36 and 38 lengthwise.

Zipper slide 48 is attached to post 52 of insert 16. Preferably, slide 48 is attached to the front face 54 of post 52, as shown in FIG. 2 so that the lower portions 36 and 38, when joined, are positioned directly behind front pendant portion 22.

The zipper bands 40 and 42 may extend to the terminus 56 of neckband 32. Preferably, however, a nonzippered pendant fabric portion 58 comprises the terminal end of the neckband and is attached to and extends from the lower end 50 of the neck loop 34 to the terminus 56. The non-zippered portion 58 is preferred to prevent the loop 34 from inadvertently being separated from the rest of the necktie 10 and for improved aesthetic appearance.

The term "zipper" is used herein to mean any device which may be used for slidably joining the edges of two pieces of fabric. The device may comprise the conventional toothed "zipper" or may for example be a continuous plastic joint or other apparatus interlockable by passage through a slide. The two edges 44 and 46 having the attached zipper bands 40 and 42 are joined by passage in one direction, e.g., downward, and separated by passage in the opposite, e.g., upward, direction. The slide 48 acts as a means for alternatively opening or closing the joint, depending upon direction of movement.

The terms "downward" and "upward" refer to vertical directions when the tie is worn by an upright standing person.

The knot insert 16 of the invention is shown in detail in FIGS. 2 through 9. As depicted in FIG. 2, insert 16 includes two enclosed elongate conduits 60 and 62 joined by support means which is here shown as connecting member 64. A downward extending post 52 is attached to or joined uniting with the connecting member 64 for fixedly positioning a zipper slide 48 below the lower ends 66 and 68, respectively, of conduits 60 and 62.

The first conduit 60 and second conduit 62 each has an enclosed elongate interior passageway 70 and 72 respectively extending from the lower ends 66 and 68 to upper ends 74 and 76, respectively. As shown in FIG. 5, the conduits 60, 62 are positioned to diverge upwardly from each other at an angle 78 from about 50 to about 90 degrees. An angle of divergence between passageway axes 79 and 81 of about 60 to about 80 degrees is more preferred; and an angle from about 65 to 75 degrees has been found to be generally optimal for forming an aesthetically pleasing knot.

The intermediate connecting member 64 which joins conduits 60 and 62 is shown in the preferred form in FIG. 2 as being a planar gusset plate joining the converging lower ends 66 and 68 of the conduits 60 and 62. The connecting member 64 may assume any form, however, so long as it fixes the desired relative positions of the conduits 60 and 62, is located to provide the proper clearance for passage of the first fabric member 12, and provide for a post member 52 to which a zipper slide may be attached.

As will be discussed in reference to FIGS. 3 and 4 hereinafter, the interior passageways 70 and 72 of the conduits 60 and 62 are generally ovate in transverse cross section. Specifically they are shown to be of a flattened ellipsoidal shape in cross-section, with a transverse major axis 80 oriented in a generally front-to-rear direction 82 normal to a plane 84 bisecting the length 126 of the conduits 60, 62 and connecting member 64.

Figure 9:
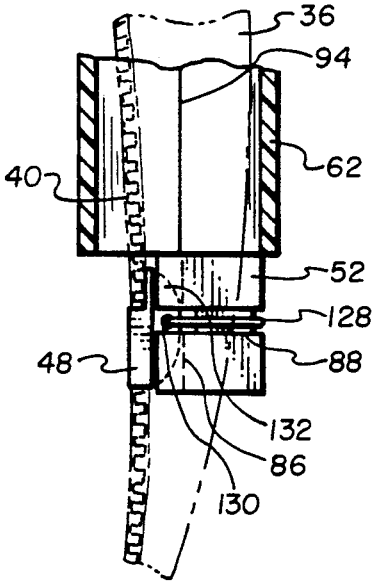
FIG. 9 is a partial sectional side view of a portion of the insert of the invention, as taken along line 9—9 of FIG. 5.

Operation means is connected to extend downward from the connecting member 64 and/or the lower ends 66, 68 of conduits 60, 62. The operating means functions to operate the linear joining means to join and disjoin the portions 36 and 38. The operation means includes post 52 which acts as a base for attachment of the zipper slide 48, on the front face 54 of post 52 as shown in FIG. 9. In the embodiment shown, the post 52 includes a vertical groove 86 on its front face 54 into which a zipper slide 48 may be inserted. A horizontal circumferential slot or groove 88 to accommodate a wire or other attachment member 90 for securing slide 48 to post 52 by passage through the eye 92 of the slide 48 and around the post 52.

In FIG. 2, insert 16 is formed in two pieces which may be fitted together along what may be regarded as a transverse plane passing through joint lines 94. The matching front piece 96 and rear piece 98 are separately illustrated in FIG. 8. The pseudosectional view of front piece 96 is along line 8A—8A of FIG. 6 and the like view of rear piece 98 is taken along line 8—8 of FIG. 5.

Figure 8:
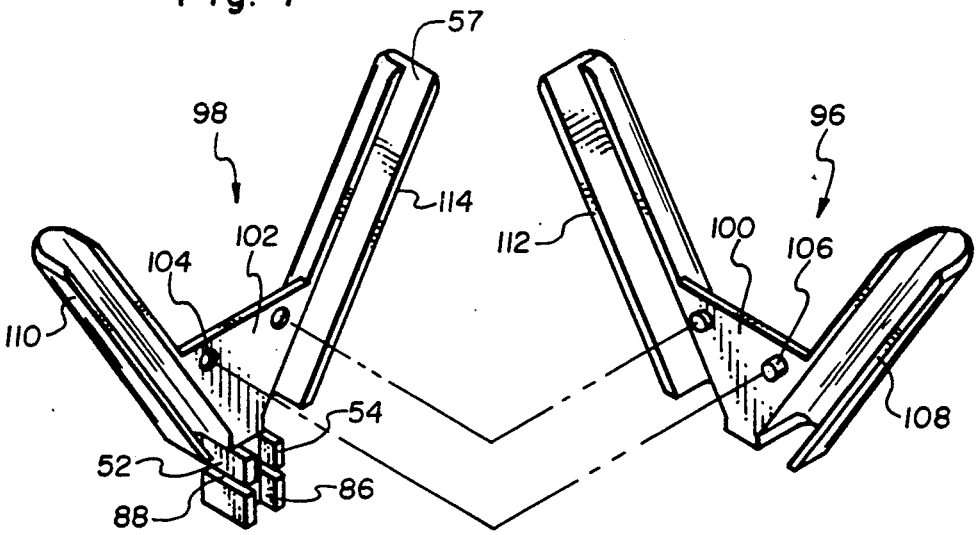
FIG. 8 is an exploded view of the two-piece insert of the invention, as taken along lines 8—8 and 8A—8A, respectively of FIG. 6.

FIG. 8 shows the split sections 100 and 102 of connecting member 64 having two or more holes or recesses 104 into which matching opposed protrusive members 106 such as pins on the other section are fitted to align their front and rear pieces 96 and 98. Corresponding split sections 108 and 110 of conduit 60 are accurately joined, as are corresponding split sections 112 and 114 of conduit 62. If desired, other convenient means such as Lips 109 and 111 (FIG. 3) may be used to align the front and rear pieces 96 and 98.

The post 52 is shown preferentially as a part of split section 102 the rear piece 98. The downward extending post 52 is adapted to hold a zipper slide similar to slide 48 on its front face 54. In this embodiment, the post 52 includes a vertical slot or groove 86 and horizontal circumferential slot or groove 88, as previously described. Other means may alteratively be used to attach the slide 48 to the post.

Although the insert 16 may be formed of any rigid or semi-rigid material, the preferred material is a lightweight plastic which has a non-abrasive surface and has sufficient strength to permit the use of thin walls. High density polystyrene (HDPS) meets these criteria. In addition, fabrics are easily joined to HDPS surfaces with conventional adhesives. Two piece inserts may be readily formed of HDPS by standard injection or vacuum molding processes.

A cross-section of conduit 60, 62 along line 3—3 of FIG. 2 is shown in FIG. 3. It is generally ovate and more specifically may be viewed as having a flattened ellipsoidal shape. The passageway 70 has a transverse dimension 80 in front-to-back direction 82, i.e., generally normal to the front panel 22 of the necktie or the connecting member 64. The passageways 70 and 72 provide for unobstructed movement of the loop portions 36, 38 with very little friction.

As shown in FIG. 1, the outer edge 116 of each neckband portion 36, 38 is turned outwardly 117 while the inner zipper edge 44, 46 is turned inwardly toward the front of the tie. The slide 48 and post 52 forces the orientation, resulting in an enfolding 118 of the neckband portions 36, 38 about those elements. Thus, the slide 48 and post 52 become hidden from lateral view; and the zipper is centrally disposed to reduce its visibility to others.

At the same time, the conduits 60 and 62 are sized in the transverse direction 82 to achieve the desired thickness of the knot 20 to simulate the natural proportions of a hand tied necktie knot.

The illustrated orientation of the conduits 60 and 62 with the transverse dimension 80 extending away from the user results in the neck loop portions 36 and 38 passing unobtrusively from the wearer's collar into the knot 20.

It may also be noted that the forced direction change from slide 48 to passageways 70, 72 results in frictional resistance to movement of the neck loop portions 36 and 38. The friction resists inadvertent loosening of the necktie 10 from the wearer once the tie 10 is positioned by the user.

A further embodiment of the conduits 60 and 62 is shown in FIG. 4. It is arcuate in cross section with generally crescent shaped passageways 70 and 72. Again, the major axis 80 lies generally in a transverse or front-to-back direction 82 as shown in FIG. 2. The two conduits 60 and 62 are oriented so that the concave surfaces 120 of the respective conduits 60 and 62 face inwardly or toward each other. Thus, the rounded outer surfaces 122 of the conduits 60 and 62 face the outer fabric covering 18 of knot 20, as depicted in FIG. 1. The knot 20 thereby has a more rounded appearance. In addition, the frictional forces resisting movement of the neck loop portions 36 and 38 may be slightly greater because of the bending forces acting on those portions.

The inner surfaces 124 of passageways 70 and 72, respectively, are smooth and burr-free. Preferably, the inner surfaces at the lower ends 66 and 68 are rounded to facilitate smooth flow of the neck loop portions 36 and 38, and to prevent zipper teeth or other protrusions from catching on these surfaces.

The two passageways 70 and 72 are oriented in a front-to-back position, i.e., normal to the plane 84 bisecting both conduits 60, 62 lengthwise. Although the most preferred angle between the major axis 80 of the passageways 70 and 72 and bisecting plane 84 is about 90 degrees, variations of about ±30 degrees are acceptable.

As previously described, one preferred arrangement of the insert 16 is formed in two pieces. A front piece 96 adjoins rear piece 98 along joint line 94 (FIG. 8). Where it is desired to provide a necktie which cannot be taken apart without cutting the fabric, the front and rear pieces 96, 98 are cemented or glued along joint line 94. The strength of the insert 16 is also enhanced thereby.

Referring to FIG. 5, it may be noted that the conduits 60 and 62 are each substantially the same in shape and in length 126. The support means and more particularly the connecting member 64 is attached to each conduit 60 and 62 along a portion of the length 126 of the conduits 60 and 62. That is, a portion 127 and 129 of each conduit extends away from the connecting member 64. The portions 127 and 129 are sized so the conduits 60 and 62 extend outwardly from the connecting member up to but not beyond the upper edge 131 of the knot 20 (FIG. 1). The cross folds 133 and 135 of the knot 20 are therefore each spaced from the zipper bands 40 and 42 to reduce wear on the cross folds and eventual deterioration of the tie. That is, the upper ends 74 and 76 are each positioned just below (e.g., 1–5 millimeters) the upper edge 131 so that the zipper bands 40 and 42 are retained in the passageways 70 and 72 to preclude contact with the cross folds 133 and 135.

A typical insert of this invention depicted in FIG. 5 will have a conduit length 126 of about 4 to about 8 centimeters and a span 128 between passageway exit centerline axes 79 and 81 of about 4 to 8 centimeters. The preferred dimensions will depend on the overall size of the necktie, keeping in mind the most aesthetically pleasing proportions of knot size to front panel size.

Figure 7:
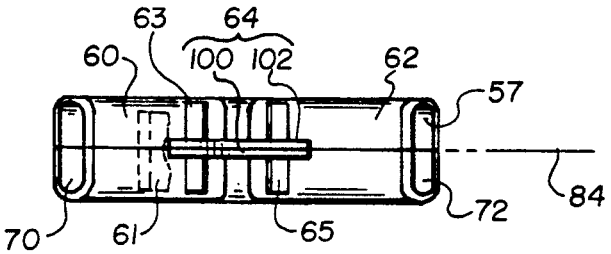
FIG. 7 is a top view of the insert of the invention.

In some arrangements the neck loop 34 and the portions 36 and 38 may be made of a material of selected thickness or composition to provide additional friction to facilitate retention of the tie in its proper position when worn with a collared shirt. In other arrangements a spring 61 may be inserted to extend arcuately from one conduit 60 to the other conduit 62. The spring 61 is sized to urge the portions 36 and 38 outwardly 59 against the inside surface 57 of the conduits 60 and 62. The spring 61 may be made of polystyrene or other suitable material. It is sized to easily fit within the insert 16 as shown in FIG. 5. The insert 16 may also have slots 63 and 65 formed in conduits 60 and 62 to receive the spring 61 as shown in FIG. 7. That is, the connecting member 64 may be sized so that the spring may pass from one conduit 62 to the other conduit 60 through notches or slots 63 and 65.

The two zipper bands 40 and 42 pass downwardly from the respective conduits 60, 62 and enter the zipper slide 48 at a point at or near the intersection 136 of passageway axes 79 and 81.

Figure 6:
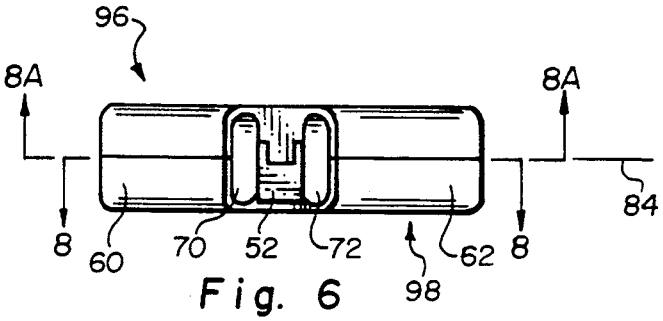
FIG. 6 is a bottom view of the insert of the invention.

FIGS. 6 and 7 are a bottom view and a top view, respectively, of a typical knot insert 16 of the invention. As shown in FIG. 6, the front piece 96 and rear piece 98 of the insert 16 are generally joined along plane 84 which bisects the conduits 60, 62, passageways 70 and 72, and connecting member 64. The latter is thus preferably formed from the two split sections 100 and 102. Post 52 is preferably wholly part of rear piece 98.

Turning now to FIG. 9, the zipper slide 48 is shown mounted on post 52 by wire means 128 which passes through an eye 130 in slide rib 132 and is crimped at the rear of post 52 to hold the slide 48 in place. The slide 48 is fixedly maintained on the desired position, because the slide rib 132 is closely held within vertical groove 86 and wire means 128 is securely held in circumferential or semi-circumferential groove 88. The relative orientation of conduit 62 and slide 48 enables the loop portion 36 to turn and conceal the post 52. The remainder of the insert 16 remains concealed, of course, by the fabric covering the knot 20 and the front panel 24 of the tie 10.

Other methods may be alternatively used for attaching the slide 48 to post 52 provided that the slide 48 is firmly held in the desired position.

The aforedescribed necktie 10 is installed by simply pulling the loop 34 away from the knot 16 to enlarge the size of the loop. The loop is then fitted over the wearer's head and under the shirt collar in the conventional manner. The portion of the neckband below the knot is then pulled downward relative to the knot, to tighten the neckband to the desired tautness.

Reference herein to details of the illustrated embodiments is not intended to restrict the scope of the appended claims which themselves recite those features regarded as important to the invention.

What is claimed is:

1. An insert for supporting a knot in a preformed necktie having a neck loop formed to have a first joinable portion and a second joinable portion each joinable to the other by linear joining means and pendant front panel portion, said insert comprising:

first conduit means having a length, a lower end, an upper end and an inner surface defining a first elongate passage sized for passage there through of a first joinable portion of the neck loop of a necktie;

second conduit means having a length, a lower end, an upper end and an inner surface defining a second elongate passage sized for passage there through of a second joinable portion of said neck loop of said necktie;

support means for fixedly connecting said first and second conduit means in the shape of a selected knot, said support means being connected to said first conduit means and to said second conduit means along their respective lengths with portions of said first conduit means and said second conduit means each extending away from said support means, each of said portions of said first conduit means and said second conduit means extending from said support means toward their respective upper ends a distance from about fifty per cent to about sixty per cent of the respective lengths of said first conduit means and said second conduit means; and operation means connected to said support means to extended away therefrom proximate said lower ends of said first and second conduit means to mechanically interact with said linear joining means for joining and disjoining said first and second joinable portions.

2. The insert of claim 1, wherein said operation means includes a post having a front and wherein said linear joining means is attached to said front of said post.

3. The insert of claim 1, wherein said first conduit means and said second conduit means are secured to said support means with their respective said lower ends positioned for bending said first and second joinable portions of said neck loop around said post.

4. The insert of claim 3, wherein each of said first and second passage has a transverse cross-section generally ovate in shape.

5. The insert of claim 1, wherein each of said first and second elongate passages has a transverse cross-section generally arcuate in shape.

6. The insert of claim 1, wherein said first and second conduit means diverge from each other at an angle from about 50 to about 90 degrees.

7. The insert of claim 6, wherein said first and second conduit means diverge from each other at an angle of 60 to 80 degrees.

8. The insert of claim 1, wherein said support means comprises a generally planar gusset plate.

9. The insert of claim 1, wherein said linear joining means is a zipper with a slide.

10. The insert of claim 9, wherein said post includes a recess on said front thereof for accepting said slide.

11. The insert of claim 10, wherein said slide has an aperture associated therein, wherein said insert includes a retaining member for positioning about said post and wherein said post includes a circumferential groove to receive said retaining member which is passed through said aperture and crimped around said post.

12. The insert of claim 1, wherein said insert comprises matching front and rear pieces which are joinable along a plane generally bisecting said first and second conduit means.

13. The insert of claim 12, wherein said insert includes means for aligning said matching front and rear pieces.

14. The insert of claim 1, wherein said first and second conduit means have a length and wherein said first and second conduit means are each separable along their lengths to form a front half and a rear half with said support means having a top portion extending between said front half of each of said first and second conduit means.

15. A performed necktie comprising:

insert means having a first conduit means and a second conduit means each having a length and an inner surface defining a passage, both conduit means having a lower end and an upper end, support means for connecting said first conduit means to said second conduit means int he shape of a selected necktie knot, and a post attached to said support means proximate said lower ends, said support means being connected to said first conduit means and to said second conduit means along their respective lengths with a portion of said first conduit means and said second conduit means each extending away from said support means, each of said portions of said first conduit means and said second conduit means extending from said support means toward their respective upper ends a distance from about fifty per cent to a bout sixty percent of the respective lengths of said first conduit means and said second conduit means;

a neck loop for encircling the neck of a user, said neck loop having a first portion and a second portion each of which have linear joining means attached thereto, said first portion and said second portion each passing through the passage of one of said first and second conduit means;

operation means connected to said support means to extend away therefrom proximate the said lower ends for mechanically interacting with said linear joining means to join and disjoin said first and second portions; and an elongated front panel member having its upper end affixed to said insert means and wrapped about said insert means to form a selected necktie knot to extend away from said insert to form a pendant front panel.

16. The necktie of claim 15, wherein each said passage of said first and second conduit means each are an elongate passageway having a transverse cross-section ovate in shape.

17. The necktie of claim 15, wherein said passage of said first and second conduit means are elongate passageways having cross-section arcuate in shape.

18. The necktie of claim 15, wherein said first and second conduit means diverge from each other at an angle from about 50 to about 90 degrees.

19. The necktie of claim 18, wherein said first and second conduit means diverge from each other at an angle of 60 to 80 degrees.

20. The necktie of claim 15, wherein said linear joining means comprises a zipper with a slide.

21. The necktie of claim 15, wherein said knot insert comprises matching front and rear pieces joinable along a plane generally bisecting said conduits.

22. The necktie of claim 1, further comprising means for aligning and joining said matching front and rear pieces.

23. The necktie of claim 22, wherein said means for aligning and joining said matching font and rear pieces comprises a plurality of protrusive members on one of said pieces and matching opposed recesses in the said piece.

* * * * *

UNITED STATES PATENT AND TRADEMARK OFFICE

CERTIFICATE OF CORRECTION

PATENT NO. : 5,170,507

DATED : 12/15/92

INVENTOR(S) : Gordon B. Langford, Shane C. Mast

It is certified that error appears in the above-indentified patent and that said Letters Patent is hereby corrected as shown below:

In Column 7, line 65, after "and" insert --a--;

In Column 8, lines 1 and 5, delete the space between "there" and "through";

In Column 8, line 23, change "extended" to --extend--;

In Column 9, line 6, change "performed" to be --preformed--;

In Column 9, line 12, change "int he" to --in the--;

In Column 9, line 23, change "a bout" to --about--;

In Column 10, line 26, change "1" to --21--;

In Column 10, line 30, change "font" to --front--;

In Column 10, line 32, before "said" insert --other--.

Signed and Sealed this

Fifteenth Day of March, 1994

*Attest:*

Bruce Lehman

BRUCE LEHMAN

*Attesting Officer*

*Commissioner of Patents and Trademarks*